US007010379B2

(12) United States Patent
Maske et al.

(10) Patent No.: US 7,010,379 B2
(45) Date of Patent: Mar. 7, 2006

(54) CONVERTER SUBSTRATE VERIFICATION

(75) Inventors: Nicholas Richard Maske, Melkbosstrand (ZA); Theunis Du Toit, Somerset West (ZA); Kenneth John Peall, Plumstead (ZA); Brian Eric Harris, KirstenHof (ZA); Werner Lombard, Somerset West (ZA)

(73) Assignee: Arvin Technologies, Inc., Troy, MI (US)

( * ) Notice: Subject to any disclaimer, the term of this patent is extended or adjusted under 35 U.S.C. 154(b) by 157 days.

(21) Appl. No.: 10/603,993

(22) Filed: Jun. 25, 2003

(65) Prior Publication Data

US 2004/0267398 A1 Dec. 30, 2004

(51) Int. Cl.
*G06F 19/00* (2006.01)

(52) U.S. Cl. ..... 700/116; 700/115

(58) Field of Classification Search ..... 700/115–116, 700/117, 215, 221, 224–227
See application file for complete search history.

(56) References Cited

U.S. PATENT DOCUMENTS

| | | | | |
|---|---|---|---|---|
| 5,755,025 | A * | 5/1998 | Wirth et al. | 29/840 |
| 6,381,843 | B1 | 5/2002 | Irie et al. | |
| 6,389,693 | B1 * | 5/2002 | Aranda et al. | 29/890 |
| 6,769,281 | B1 * | 8/2004 | Irie et al. | 72/121 |
| 2003/0000088 | A1 * | 1/2003 | Mayfield | 29/890 |

* cited by examiner

*Primary Examiner*—Leo Picard
*Assistant Examiner*—Ryan A. Jarrett
(74) *Attorney, Agent, or Firm*—Carlson, Gaskey & Olds

(57) ABSTRACT

A substrate verification system is utilized for verifying substrate location and orientation in a catalytic converter mat wrapping mechanism. A mat wrap mechanism reads data from a substrate. A verification mechanism compares the identifier data with stored data. If the substrate is verified as correct, the verification mechanism activates the mat wrap mechanism. If the data from the substrate does not match the data in a system an alert is activated. If there is an error, the wrapping process will not be activated. The present invention therefore provides a substrate verification system for verifying substrate location and orientation.

21 Claims, 3 Drawing Sheets

CONVERTER SUBSTRATE VERIFICATION

BACKGROUND OF THE INVENTION

The present invention relates to a verification system for use in assembly of catalytic converter substrates. Catalytic converters are used in vehicles to convert harmful substances in the exhaust from internal combustion engines to harmless substances prior to releasing the exhaust into the environment. Catalytic converters utilize ceramic substrates coated in the appropriate catalysts to convert the exhaust after it leaves the engine. The substrates are configured to withstand high heat environments and last over a long period of time. To extend the life of the substrates they are wrapped in mats prior to being encased in a housing. The mats assist in protecting the substrates from friction and pressure damage that may occur over time due to shifting in the housing.

One catalytic converter assembly may house several catalytic substrates. The substrates are manufactured such that different catalysts are utilized to eliminate different contaminants out of the exhaust. Although the substrates may have different filtration characteristics the substrates often have similar structures and can easily be mistaken for one another. In addition the configuration of each substrate may allow for it to be assembled in the wrong position within the mat wrap. Both the filtration characteristics and correct configuration of the substrate are difficult to detect. Because of this the substrates are often misassembled within the mat wrap. Misassembly may cause lower performance of a catalytic converter.

Accordingly, it is desirable to provide a system for assembling substrates that confirms the correct part is used and the correct configuration of the substrate has occurred prior to mat wrap of the substrates.

SUMMARY OF THE INVENTION

A substrate verification system of the present invention is utilized for verifying substrate location and orientation in a catalytic converter mat wrapping mechanism.

The process begins when a wrap mechanism operator starts a verification system. This starts a verification mechanism and a mat wrap mechanism. A mat wrap is placed on a wrap surface of the wrapping mechanism. A substrate is placed on the mat wrap in a correct location and orientation. A substrate identifier attached to the substrate should be facing a reader. Additional substrates may also be placed on the mat wrap for catalytic converters which utilize more than one substrate. In this instance the additional substrates will each have their own identifier. Additional readers may be used to read the additional identifiers. The readers are activated to read the identifiers. The data from the identifiers is input by the readers into a computer. The results are displayed on a monitor. If the identifier data matches data in the computer the substrates are verified as being in the correct location and orientation.

If all the substrates are verified as correct, the verification system activates the mat wrap mechanism. Wrap rollers apply the mat wrap to the substrates. The mechanism then places the wrapped substrate in a converter housing. The computer generates a converter label. The printer is activated to output a converter label with the new information. The converter label is applied to the wrapped substrate. A completed converter assembly is removed from the wrap mechanism. A new mat is placed in the wrap mechanism and the process is repeated for another converter assembly.

If the data from any of the substrates does not match the data in a system an alert is activated. If there is an error, the wrapping process will not be activated. The operator will need to correct the error and reactivate the verification system to continue. The present invention therefore provides a substrate verification system for verifying substrate location and orientation in a catalytic converter mat wrapping mechanism.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
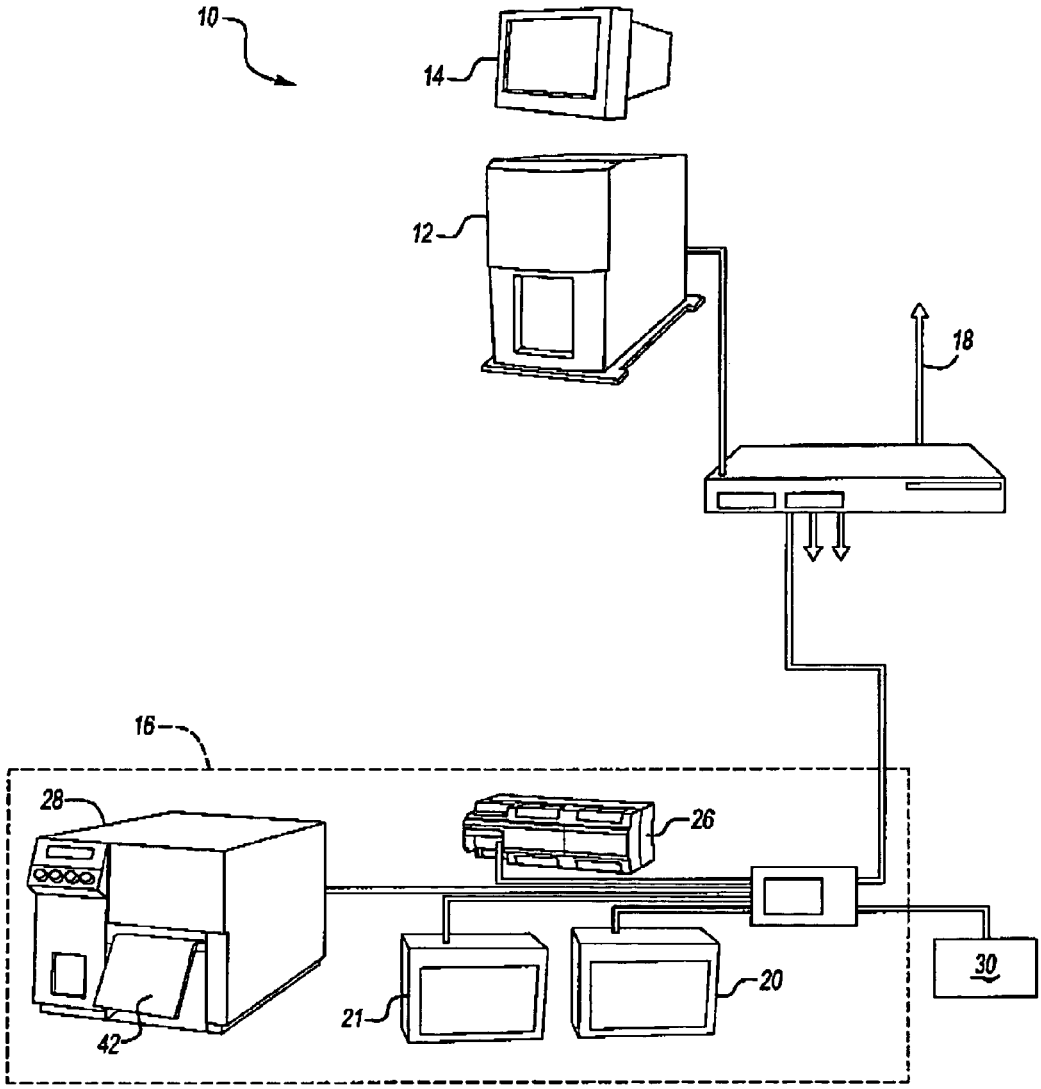
FIG. 1 is a configuration of the substrate verification system of the present invention.

FIG. 1 discloses a substrate verification system 10 utilized for verifying substrate location and orientation in a catalytic converter mat wrapping mechanism 30. The substrate verification system 10 includes a verification mechanism 16 and a mat wrapping mechanism 30. A computer 12 and monitor 14 are connected to a verification mechanism 16. The computer 12 is connected to the verification mechanism 16 through a network 18. The network 18 is connected to other computers for the input of information and connected to other verification systems so multiple wrapping mechanisms may utilize the same information. A controller 26 is also connected to and controls a substrate wrap mechanism 30 as described below. The controller 26 could be a PLC, or a CPU including a processor, memory and storage, and suitably programmed to perform the functions described herein.

Figure 3:
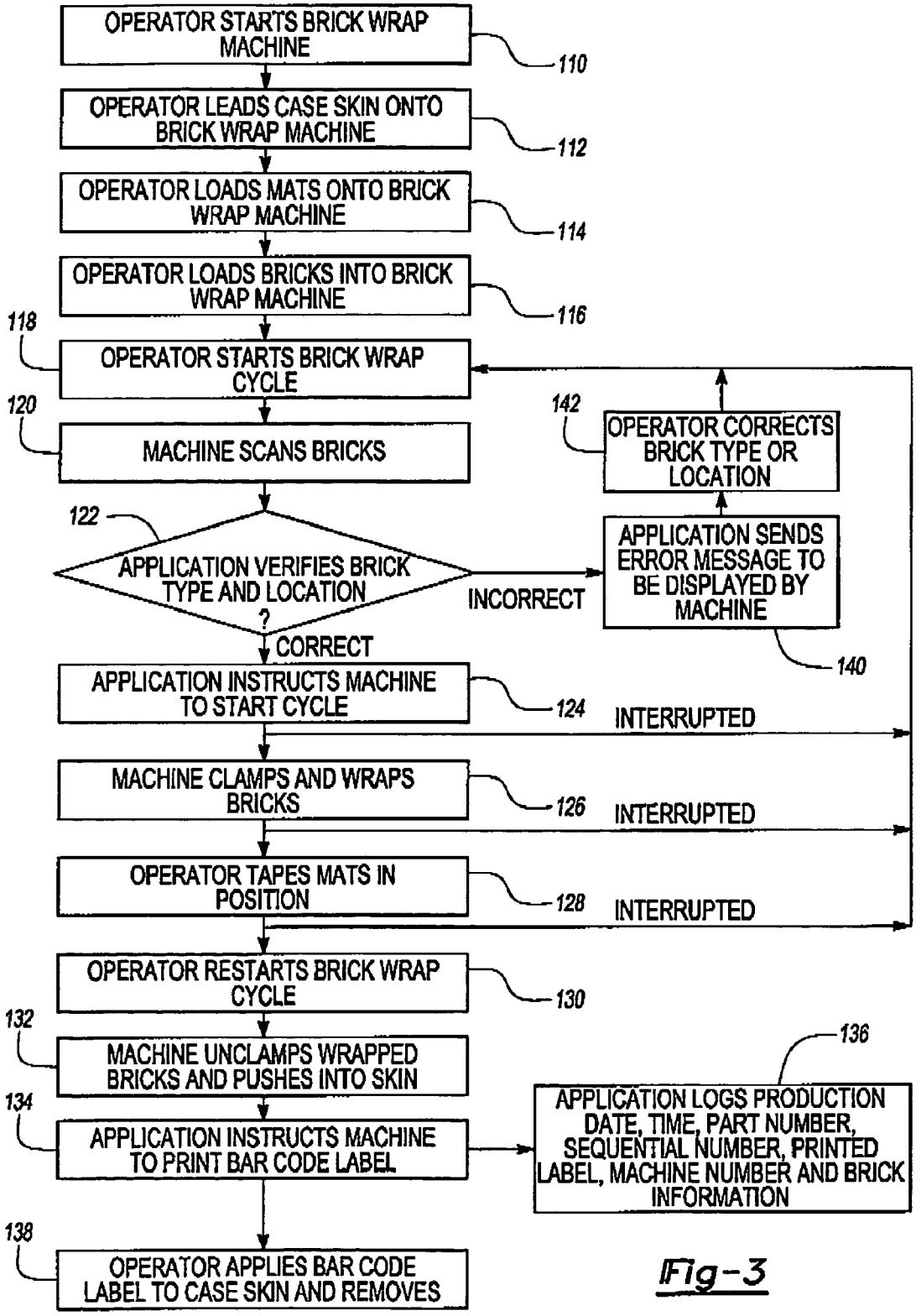
FIG. 3 is a process flow chart of the substrate verification system of the present invention.

The verification mechanism 16 includes at least a first reader 20 for reading a first identifier 22 located on a first substrate 24 (shown in FIG. 3). It should be understood that commonly known devices such as barcodes, optical character recognition, transponders, or the like could be used for the identifiers. The corresponding equipment to read the data would then be used for the reader. For example, in the preferred embodiment the identifier is a barcode, and the reader is a barcode scanner. In addition, there will be preferably one reader for each substrate required in a catalytic converter. In the embodiment shown there are a first and second substrates 24, 36 and a corresponding first and second readers 20, 21. The computer 12 analyzes the information read by the readers 20, 21. A printer 28 is also connected for printing a converter label 42 for wrapped substrate information after completion of the verification and wrapping process. The converter label 42 may be of the same type or vary in type from the substrate identifiers 22, 38.

Prior to running a new converter type a change card is read in by the readers 20 and 21. The change card notifies the computer 12 which data to gather from a database located on the network. The data in the computer 12 may include information associating identifier data with information such as the correct part number, position, and orientation information for each substrate to be placed in converter assembly. The computer may also include other information that would be useful.

Figure 2:
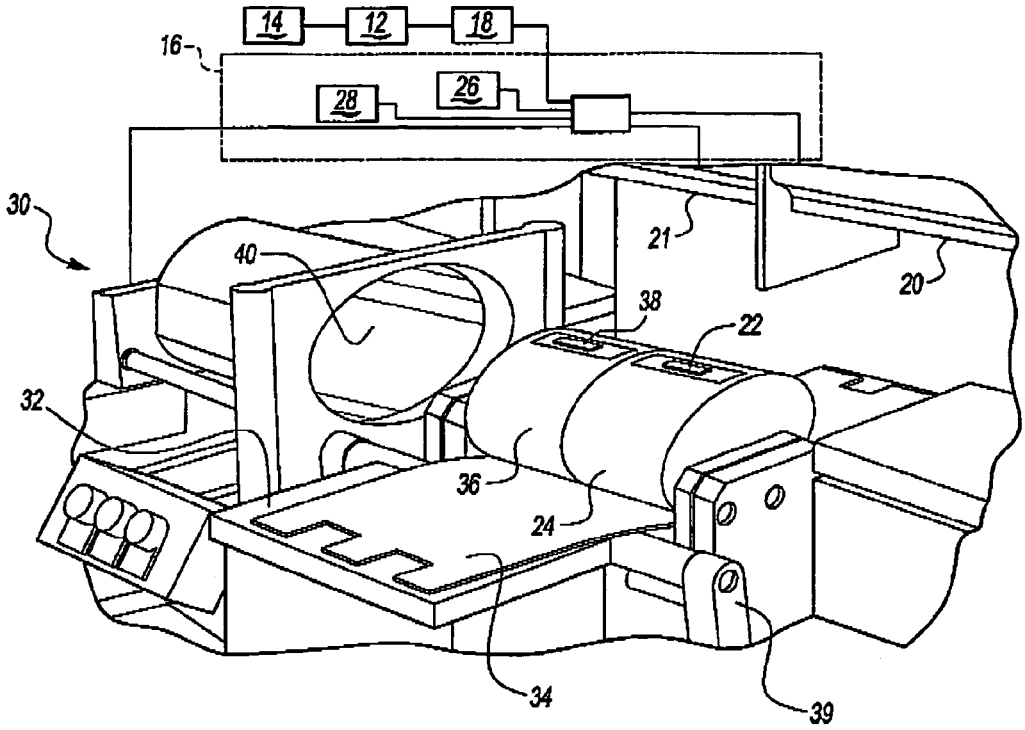
FIG. 2 is a view of the mat wrap station of the preferred embodiment of the substrate verification system with a mat and substrate in position.

FIG. 2 shows the substrate verification system 10, with the substrate wrap mechanism 30 shown in more detail. The substrate wrap mechanism 30 includes a mat wrap surface 32. Adjoining the mat wrap surface 32 are the mat wrap rollers 39 for applying a mat wrap to substrates. Adjacent the mat wrap surface 32 and the wrap rollers 39 is a converter housing 40. The housing 40 is in a perpendicular orientation to the mat wrap surface 32 thus allowing the wrapped substrates to be easily placed in the converter housing 40. Located adjacent the wrap surface 32 are the readers 20 and 21. The readers 20 and 21 and the wrap mechanism 32 are both attached to the verification mechanism 16.

FIG. 3 shows a process flow chart of the wrapping and verification process of the substrate verification system 10 of FIG. 2. Referring to FIGS. 2 and 3, the process begins when a wrap mechanism operator starts the verification mechanism 16 and the substrate wrap mechanism 30, shown in step 110. Other configurations of wrap mechanisms 30 may be utilized with the verification system 10 of the present invention. A converter housing 40 is placed in the wrap mechanism 30 for later assembly, shown in step 112. A mat wrap 34 is placed on a wrap surface 32 of the wrapping mechanism 30 in step 114.

At least a first substrate 24 is placed on the mat wrap 34 in a location and an orientation in step 116. The identifier 22, should be facing the first reader 20 to be readable by the first reader 20. The first identifier 22 contains information regarding the first substrate 24. This information may include the substrate part number, a substrate batch number and a sequential number.

The preferred embodiment shows a catalytic converter utilizing two substrates 24, 36. The second substrate 36 is also placed on the mat wrap 34 in a location and an orientation in step 116. A second identifier 38 on the second substrate 36 should also be readable by the first reader 20. The second substrate 36 may have a different configuration and include different filtration characteristics from the first substrate 24. It is important to verify that both the first substrate 24 and the second substrate 36 are in the correct positions and orientations. The second identifier 38 will have similar information relating to the second substrate 36. The identifiers 22, 38 also indicate the orientation of the substrates 24, 36 to the readers 20, 21.

A second reader 21 may be used to read the second identifier 38. This will improve the efficiency of the verification system 10 allowing both the first identifier 22 and the second identifier 38 to be read simultaneously. The first and second readers 20 and 21 are activated to read the first identifier 22 and second identifier 38 in steps 118 and 120. The data from the barcodes 22, 38 is input by the first and second readers 20 and 21 into the computer 12. The computer 12 gathers the correct data for each converter from a database on the network.

The data in the computer 12 is compared to the identifier data on the first and second identifiers 22 and 38, step 122. The results are displayed on the monitor 14. If the identifier data matches the data in the computer 12 the substrates 24, 36 are verified as being in the correct location and orientation.

Figure 4:
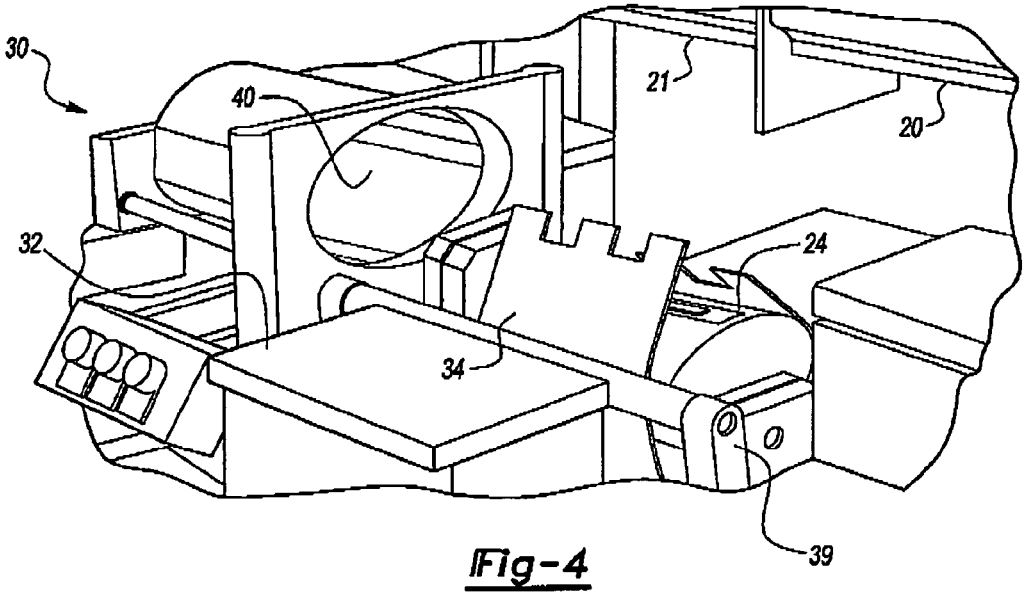
FIG. 4 is a view of the mat wrap station of the preferred embodiment of the substrate verification system with a mat being wrapped about a substrate.

If both the first substrate 24 and the second substrate 36 are verified as correct the controller 26 activates the mat wrap mechanism 30 in step 124. Wrap rollers 40 apply the mat wrap 34 to the first and second substrates 24, 36, step 126. FIG. 4 shows the wrap mechanism 30 applying the mat wrap 34 to the first substrate 24 and the second substrate 36. Once the mat wrap 34 is in position the operator may apply tape to hold the mat wrap 34 in place around the wrapped substrate, step 128.

The wrap mechanism 30 then places the wrapped substrate in a converter housing 40, steps 130–132. The computer 12 generates a converter label 42. The printer 28 is activated to output a converter label 42 with the new information, step 134. The information printed on the converter label 42 is stored in the computer 12, step 136. This information may include production date, production time, converter part number, a sequential number, the wrap mechanism number, information regarding the substrates included in the assembly, and any other information that may be found useful. The information is obtained from databases on the network, the reader data, and computer generated data. The converter label 42 is applied to the converter assembly, step 138. A completed converter assembly is removed from the wrap mechanism 30. A new mat is placed in the wrap mechanism 30 and the process is repeated for another converter assembly.

If the data from either the first substrate 26 or the second substrate 36 does not match the data in a system an alert is activated. The system alert is displayed on the monitor 14 such that the operator can see what error has occurred, step 140. Warning lights may also be activated to alert the operator of an error. If there is an error the controller 26 directs the wrapping mechanism 30 not to activate. The operator will need to correct the error and reactivate the verification system 10 to continue, step 142. The process will restart, at step 118, by again reading the information on the first and second substrates 24, 36.

The foregoing description is only illustrative of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention. The alphanumeric references included in the claims are for easier reference between claims and are in no way intended to limit the order in which a method may be completed.

What is claimed is:

1. A substrate verification system for converter substrates comprising:

a wrap mechanism with a wrap surface;

a mat wrap on said wrap surface of said wrap mechanism;

at least one substrate on said wrap mechanism on top of said mat wrap;

a reader mounted adjacent said wrap surface for reading an identifier on said substrate; and a controller programmed to compare the identifier on said substrate to stored data prior to activation of said wrap mechanism.

2. The verification system in claim 1 wherein the reader is one of a plurality of readers.

3. The verification system in claim 1 wherein said identifier is a barcode and said reader is a barcode scanner.

4. The verification system in claim 1 wherein the wrap mechanism includes a wrap roller to apply said mat wrap to said at least one substrate.

5. The verification system as recited in claim 1, wherein a computer is connected to said controller, said computer for input and storage of said stored data.

6. The system as recited in claim 5, wherein a printer is attached to said verification system to create a converter label using information from said computer.

7. The system as recited in claim 6, wherein said information includes data from said identifier, data stored on said computer, and data generated by said computer.

8. A method of verifying a substrate comprising the steps of:

a) placing a mat wrap on a wrap mechanism;

b) placing a substrate with an identifier on the mat wrap;

c) reading data associated with the identifier on the substrate with a computer verification system; and d) comparing the data associated with the identifier with stored data prior to activation of the wrap mechanism.

9. The method as recited in claim 8, wherein said step d) further includes comparing an orientation of said substrate against said stored data.

10. The method as recited in claim 8, wherein said step d) further includes comparing a substrate part number against said stored data.

11. The method as recited in claim 8, further including the step of:

e) activating a system alert when the identifier data does not match the stored data.

12. The method as recited in claim 11, further including the step of:

f) inhibiting operation of the wrap mechanism and waiting for an operator to check the alert based upon said step e).

13. The method as recited in claim 12, further including the step of:

g) the operator restarting the wrap mechanism after checking the alert.

14. The method as recited in claim 8, further including the step of:

h) applying the mat wrap to the substrate if the computer verification system confirms the substrate is correct.

15. The method as recited in claim 14, further including the steps of:

i) placing the substrate in a converter housing;

j) printing a converter label; and k) applying the converter label to the converter housing.

16. A method of verifying a substrate comprising the steps of:

a) placing a mat wrap on a wrap mechanism;

b) placing a substrate on the mat wrap; and c) reading the substrate with a computer verification system to verify orientation or position of the substrate prior to activation of the wrap mechanism.

17. The method as recited in claim 16, further including the step of:

d) activating a system alert based upon a determination that the substrate is in the incorrect orientation or position.

18. The method as recited in claim 17, further including the step of:

c) inhibiting operation of the wrap mechanism and waiting for an operator to check the alert based upon a determination that the substrate is in the incorrect orientation or position.

19. The method as recited in claim 18, further including the step of:

g) the operator activating the wrap mechanism after checking the alert after said step e).

20. The method as recited in claim 16, further including the step of:

h) applying the mat wrap to the substrate based upon a confirmation by the computer verification system that the substrate is in the correct position and orientation.

21. The method as recited in claim 20, further including the steps of:

i) placing the substrate in a converter housing;

j) printing a converter label; and k) applying the converter label to the converter housing.

* * * * *